US009999824B2

(12) United States Patent
Brosseau, Jr.

(10) Patent No.: US 9,999,824 B2
(45) Date of Patent: Jun. 19, 2018

(54) PORTABLE GOLF MAT

(71) Applicant: Donald Oswald Brosseau, Jr., Pacoima, CA (US)

(72) Inventor: Donald Oswald Brosseau, Jr., Pacoima, CA (US)

( * ) Notice: Subject to any disclaimer, the term of this patent is extended or adjusted under 35 U.S.C. 154(b) by 0 days. days.

(21) Appl. No.: 15/490,287

(22) Filed: Apr. 18, 2017

(65) Prior Publication Data

US 2017/0296898 A1 Oct. 19, 2017

Related U.S. Application Data

(60) Provisional application No. 62/324,105, filed on Apr. 18, 2016.

(51) Int. Cl.
*A63B 69/36* (2006.01)

(52) U.S. Cl.
CPC ..... *A63B 69/3661* (2013.01)

(58) Field of Classification Search
USPC ..... 473/131, 278, 405, 407, 409
See application file for complete search history.

(56) References Cited

U.S. PATENT DOCUMENTS 3,578,333 A * 5/1971 Elesh ..... A63B 69/3661 473/171
3,578,542 A 5/1971 Migitz
3,643,961 A 2/1972 Schroeder
3,661,687 A 5/1972 Spinney, Jr. et al.
4,244,576 A * 1/1981 Mosier ..... A63B 67/02 273/DIG. 30
4,268,551 A 5/1981 Moore, Jr.
4,497,853 A 2/1985 Tomarin
4,505,960 A 3/1985 Leffingwell
4,875,685 A 10/1989 Ballinger et al.
4,932,663 A 6/1990 Makar
4,946,719 A 8/1990 Dempsey
5,026,580 A 6/1991 Hammon
5,028,052 A 7/1991 Miller
5,046,741 A * 9/1991 Ahn ..... A63B 69/3652 473/279
5,156,398 A 10/1992 Kibamoto
5,273,285 A 12/1993 Long
5,460,380 A 10/1995 Ober
5,593,355 A 1/1997 Beaver
5,605,721 A 2/1997 Di Geronimo
5,888,147 A * 3/1999 Luedtke ..... A63B 69/3661 473/278
5,908,673 A 6/1999 Muhlberger
(Continued)

OTHER PUBLICATIONS http://divottutor.com; Tom & Tome LLC. 4 pages.

*Primary Examiner* — Nini Legesse
(74) *Attorney, Agent, or Firm* — St. Onge Steward Johnston & Reens, LLC

(57) ABSTRACT

A mat for practicing golf shots, including an upper mat and a lower mat. The lower mat is larger than the upper mat. The upper mat is secured on top of the lower mat such that the additional area of the lower mat extends in the direction of the anticipated trajectory of a golf club head. A golf ball is placed on the edge of the upper mat such that the club head will travel through the empty space above the lower mat and in front of the lower mat. As a result, the golfer experiences less force due to the club head striking the mat.

23 Claims, 6 Drawing Sheets

(56) References Cited

U.S. PATENT DOCUMENTS

| | | | | |
|---|---|---|---|---|
| 5,910,053 | A * | 6/1999 | Scalise | A63B 69/3667 473/257 |
| 6,156,396 | A | 12/2000 | Florian | |
| 6,221,445 | B1 | 4/2001 | Jones | |
| 6,241,621 | B1 * | 6/2001 | Maher | A63B 63/007 473/162 |
| 6,527,889 | B1 | 3/2003 | Paschal et al. | |
| 6,547,681 | B1 * | 4/2003 | Wood | A63B 24/0021 473/278 |
| 6,723,412 | B2 | 4/2004 | Prevost | |
| 6,740,387 | B1 | 5/2004 | Lemieux | |
| 6,746,752 | B2 | 6/2004 | Prevost | |
| 6,902,494 | B1 | 6/2005 | Frishberg | |
| 7,357,966 | B2 | 4/2008 | Dipple et al. | |
| 7,384,346 | B2 | 6/2008 | McFarlin et al. | |
| 7,955,194 | B2 | 6/2011 | Avery | |
| 8,147,939 | B2 | 4/2012 | Horio et al. | |
| 8,157,667 | B2 | 4/2012 | Tome et al. | |
| 8,263,203 | B2 | 9/2012 | Reddick | |
| 8,944,128 | B2 | 2/2015 | Glain et al. | |
| 9,089,755 | B2 | 7/2015 | Holland | |
| 2002/0039929 | A1 | 4/2002 | Morris | |
| 2005/0049069 | A1 | 3/2005 | Speck | |
| 2006/0128493 | A1 | 6/2006 | Snopkowski | |
| 2008/0032811 | A1 | 2/2008 | Bearden | |
| 2008/0096684 | A1 | 4/2008 | Lara et al. | |
| 2008/0104914 | A1 | 5/2008 | Lemieux | |
| 2008/0125237 | A1 | 5/2008 | Avery | |
| 2008/0141516 | A1 | 6/2008 | Julicher et al. | |
| 2009/0286019 | A1 | 11/2009 | Bihl | |
| 2015/0376844 | A1 | 12/2015 | Palau Gea et al. | |

* cited by examiner

PORTABLE GOLF MAT

FIELD OF THE INVENTION

The invention relates to golf equipment. More particularly, the invention relates to equipment for assisting golfers with practicing their shots.

BACKGROUND OF THE INVENTION

Many commercial driving ranges at which golfers may practice their shots use artificial turf instead of real grass turf. This is done largely because maintaining real grass turf at a driving range is extremely difficult and costly. This is because many golf shots, particularly iron shots, involve the golfer making a divot. Divots are pieces of the turf that are dug up and removed by the golf club head as the head passes through a trajectory to strike the ball. In a typical, well-struck golf shot, the divot is created directly in front of the location of the ball. In a "fat" type of mishit, the divot is created at least partially behind the location of the ball. In any event, divot-making is a common and frequent part of many golf shots.

It will be understood by those of skill in the art that references to "in front of" the ball mean down range or in the direction of the intended target, while "behind" the ball means away from the intended target of the shot. Put another way, "behind" the ball is the region through which the golfer takes his or her backswing, while "in front of" the ball is the region through which the golfer's club travels on the follow-through after the ball is hit.

Practice golf mats made of artificial turf do not permit a divot to form. This causes the impact between the club head and the artificial turf to be much more severe than the impact between a club head and natural grass turf. As a result, a golfer hitting golf balls off of an artificial mat will experience much higher shock in his or her hands and arms due to the larger force being transmitted from the head and shaft of the club. It is well-known that this increased force significantly increases the risk of the golfer developing tendinitis.

Artificial turf also gives false feedback to the golfer on "fat" hits. A fat hit is one in which the club head strikes the ground too early in the swing trajectory, i.e., behind the golf ball. On natural grass, an improper "fat" hit is easy to identify: a large, deep divot and an obviously bad shot. On artificial turf, however, the club head will behave quite differently. During a fat hit on artificial turf, the club head will still make solid contact with the ball due to the fact that it cannot sink into the turf below the ball. The club head will bounce off of the artificial turf and make reasonably good contact with the ball. There will be no telltale divot, and the shot is likely to appear better than it would have off of natural grass.

There have been a number of attempts to address the foregoing problems with artificial turf practice mats. These attempts fall into two general categories: (1) including some type of suspension system under the surface from which the ball is hit so that the surface will deflect downwards when the ball is struck, or (2) permitting the surface from which the ball is hit to move laterally along the ground when struck by the club.

For example, U.S. Pat. No. 4,932,663 ("the '663 patent") discloses a golf swing practice mat that utilizes two layers of artificial turf to support the golf ball. Both layers of turf are secured independently to a frame, and the top layer is secured using elastic straps. In this design, the mat has vertical "give" and the top layer is intended to slide on top of the bottom layer to simulate the shock associated with taking a divot from the ground of a natural golf course. In one embodiment, a series of layers of green nylon netting attached to the frame using a tether. The layers of netting are intended to simulate divots when a ball is struck off of the mat.

U.S. Pat. No. 5,888,147 ("the '147 patent") discloses a golf practice mat that includes an artificial turf "anchor piece" and an artificial turf "divot piece." The anchor piece is secured to the ground using golf tees and is secured to the divot piece using a combination of elastic rubber bands and nylon cord. The bands and cord allow the divot piece to slide forward away from the anchor piece when a user strikes a golf ball off of the divot piece.

The systems disclosed in the '663 and '147 patents (as well as numerous other, similar systems) are purported to reduce the impact force felt by a golfer. But, the reduction in force is not enough to make the practice shots feel similar to comparable shots off of natural turf. In these systems, the club still has to transmit sufficient force to deflect the surface downward against the force of the suspension system and/or forward across the ground even on properly struck shots. Further, these systems still give inaccurate feedback on "fat" hits.

What is needed, therefore, is a mat for practicing golf shots that provides an accurate simulation of golf shots hit off of natural turf. What is also needed is mat that transmits a reduced force to the golfer that is actually similar to the force involved in a golf shot off of natural turf. What is also desired, is such a mat that is compact, lightweight, and easy and inexpensive to manufacture and maintain.

SUMMARY OF THE INVENTION

It is an object of the present invention to provide an improved golf practice mat that provides an accurate simulation of golf shots hit off of natural turf.

It is a further object of the present invention to provide a golf practice mat that transmits a reduced force to the golfer that is actually similar to the force involved in a golf shot off of natural turf.

It is a further object of the present invention to provide a golf practice mat that is compact, lightweight, and easy and inexpensive to manufacture and maintain.

One or more of these and other objects are at least partially achieved by embodiments of the invention that include an upper mat, a lower mat that is longer than the upper mat, and a connector that secures the upper mat on top of the lower mat. The mats are arranged such that space is created in front of a golf ball placed on the upper mat adjacent to the edge of the upper mat. By setting the ball in a position where the golfer's club can follow a normal trajectory through the ball while hitting little more than air, the golfer is spared the force of hitting the mat.

According to a first embodiment of the present invention, a golf swing practice device is provided, that comprises: a lower mat having first and second ends, a first length and a first thickness; an upper mat having first and second ends, a second length and a second thickness, wherein the second length is less than the first length; and a first connector that substantially secures the upper mat on top of the lower mat. The upper mat is arranged on top of the lower mat such that the first ends of the mats are substantially aligned and the second ends of the mats are separated by approximately the difference between the second and first lengths.

In some embodiments, the lower mat and the upper mat each comprise at least one opening adjacent the first end of each mat and the first connector comprises an elastic cord threaded through each of the at least one openings. In some embodiments, the lower mat comprises a first opening and a second opening adjacent the first end of the lower mat, and the upper mat comprises a third opening and a fourth opening adjacent the first end of the upper mat. In some embodiments, the device further comprises that each of the first, second, third, and fourth openings comprises a grommet.

In some embodiments, the first connector limits movement of the upper mat relative to the lower mat along the first length of the lower mat to no more than approximately 20% of the second length. In some embodiments, the device further comprises an anchoring connector connected to the first connector for substantially anchoring the device against movement in at least one direction.

In some embodiments, the second thickness is less than the first thickness. In some embodiments, the second length is approximately ⅔rds of the first length. In some embodiments, the second thickness is approximately ⅝ths of an inch and the first thickness is approximately ¾ths of an inch. In some embodiments, the upper and lower mats comprise an artificial grass surface.

According to a second embodiment of the present invention, a method for reducing the force of a golf club striking a surface during golf shots is provided. The method comprises the steps of: securing a first playing surface on top of a second playing surface, the first playing surface having a smaller surface area than the second playing surface, wherein the playing surfaces are arranged such that an additional surface area of the second playing surface extends in the direction of an anticipated trajectory of a club head of a golf club; placing a golf ball on the first playing surface nearest an edge of the first playing surface that is nearest the additional surface area of the second playing surface; and swinging the golf club such that the club head of the golf club strikes the ball before passing over the edge of the first playing surface.

In some embodiments, the method further comprises the step of securing the first and second playing surfaces to an object such that movement of the first and second playing surfaces is substantially eliminated in the direction of the anticipated trajectory of the club head. In some embodiments, the step of securing the first playing surface on top of the second playing surface further comprises using an elastic connector for said securing.

According to a third embodiment of the present invention, a golf swing practice device is provided, comprising: an upper mat having a first surface area, a first end, a second end, and at least one opening adjacent to the first end of the upper mat; a lower mat having a second surface area, a first end, a second end, and at least one opening adjacent to the first end of the lower mat, wherein the second surface area is greater than the first surface area; a first connector threaded through the openings such that the upper mat is on top of the lower mat and the first ends of the mats are substantially aligned; and an anchoring connector connected to the first connector for substantially anchoring the device against movement in at least one direction. The upper and lower mats are arranged such that the second end of the upper mat is separated from the second end of the lower mat by a length of the additional surface area of the lower mat.

In some embodiments, the first connector is elastic and is arranged to limit movement of the upper mat relative to the lower mat along an axis extending from the first end to the second end of the lower mat to no more than approximately 20% of a length the upper mat. In some embodiments, the anchoring connector is a substantially inelastic cord. In some embodiments, the upper mat comprises two openings adjacent the first end of the upper mat and the lower mat comprises two openings adjacent the first end of the lower mat, and wherein each opening comprises a grommet.

In some embodiments, the upper mat and the lower mat are each approximately ⅝ths of an inch thick. In some embodiments, the first surface area is approximately ⅔rds of the second surface area. In some embodiments, the upper mat and the lower mat have approximately the same width.

Additional aspects and features of the present invention will be apparent from the attached drawings and the below detailed description.

DETAILED DESCRIPTION OF THE INVENTION

The figures show certain embodiments of the present invention having a variety of features. It will be understood by those of skill in the art that not all of the features of each embodiment depicted or described are necessarily present in other possible embodiments of the invention.

Figure 1:
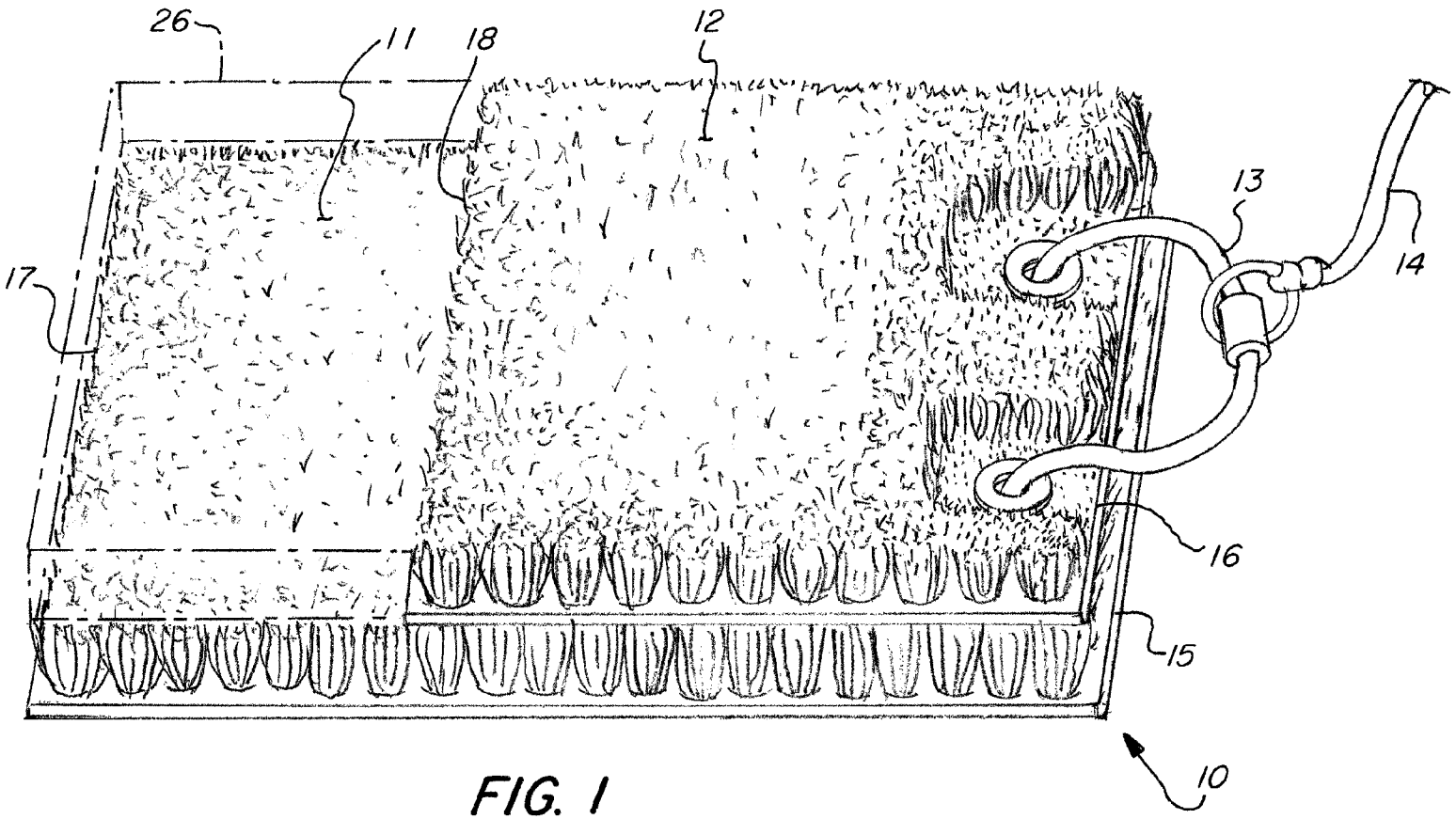
FIG. 1 is an elevation view of a first embodiment of the present invention.

FIG. 1 shows an elevation view of a first embodiment of the present invention. The golf practice mat 10 includes a lower mat 11 and an upper mat 12. The lower and upper mats are secured together by a first connector 13, which is attached to an anchoring connector 14. The upper and lower mats each have first and second ends. The first ends 15 and 16 of the mats are substantially aligned. The second ends 17 and 18 are not aligned due to the larger size of the lower mat 11. The lower mat 11 has a larger surface area than the upper mat 12. In the embodiment shown and in most preferred embodiments, this additional surface area is due to the greater length of the lower mat as compared to the upper mat. This, combined with the alignment of the first ends 15 and 16, results in an open space 26, delineated by the dashed lines shown in FIG. 1.

In the embodiment of FIG. 1, the lower mat 11 is in the shape of a rectangle that is approximately 12 inches long (i.e., the distance from the first end 15 to the second end 17 is approximately 12 inches) and 7 inches wide (i.e., the sides of the rectangle on each of the first and second ends are approximately 7 inches). As described and referred to herein, the "length" or the "longitudinal axis" of the mat refer to the dimension extending between the first and second ends. In the embodiment of FIG. 1, the upper mat 12 is also in the shape of a rectangle, but is 8 inches long (from first end to second end) and is 7 inches wide. Thus, the upper and lower mats are the same width in this embodiment, but the upper mat 12 is ⅔rds of the length of the lower mat 11.

In other embodiments, the lower mat is approximately twice as long as the upper mat. Such an arrangement better accommodates less experienced golfers as it provides a larger area over which the golfer swings. This reduces the likelihood that the golfer will damage his or her club due to a particularly bad swing. The size of the upper mat in other embodiments generally ranges from about 4 inches long and 4 inches wide to about 10 inches long and about 10 inches wide. Likewise, the size of the lower mat generally ranges in size from about 6 inches long and 4 inches wide to about 20 inches long and about 10 inches wide. Other sizes, particularly larger sizes, are used in some specific applications, such as at a golf simulator as described below.

Figure 2:
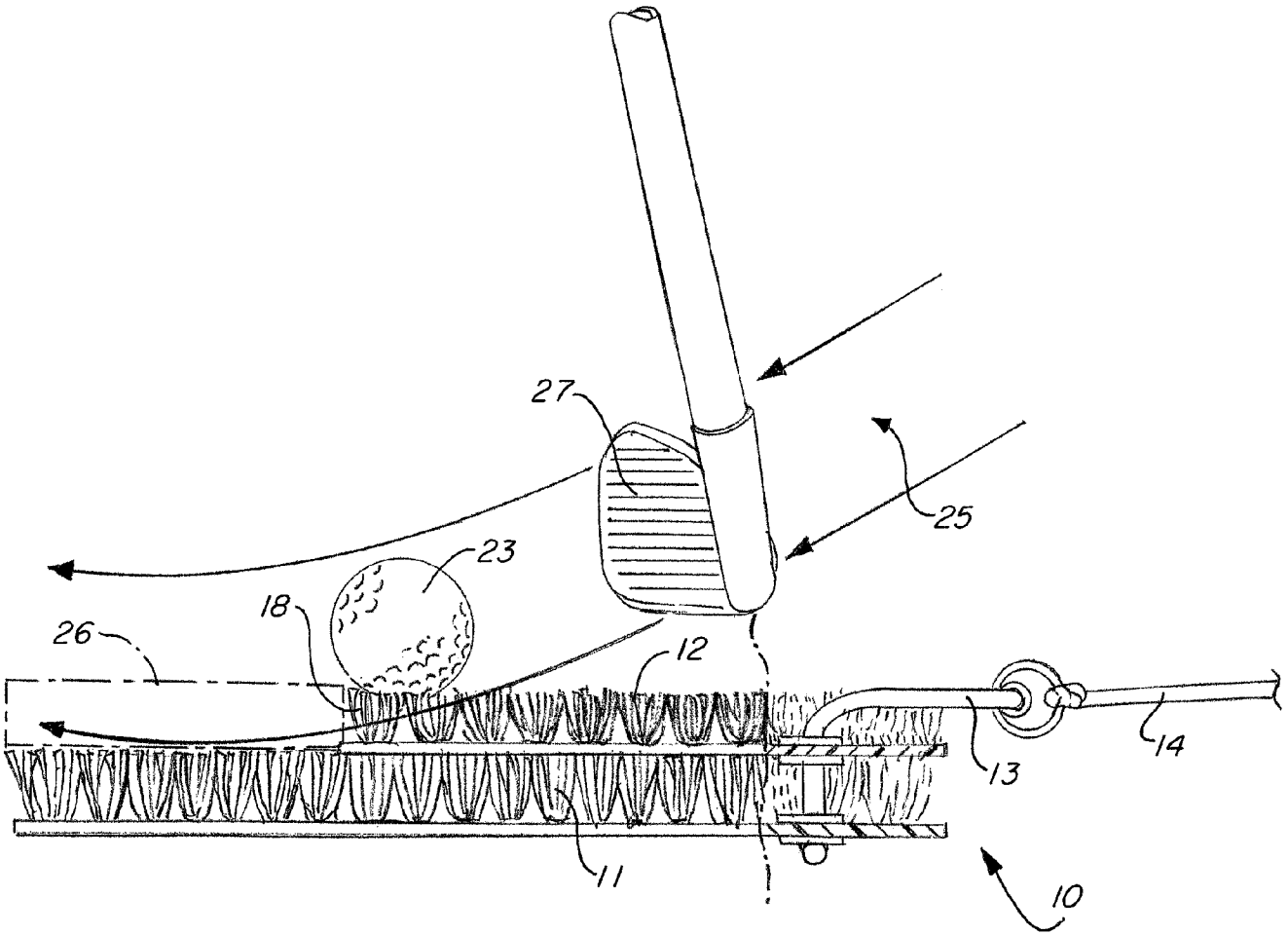
FIG. 2 is a side view of the embodiment shown in FIG. 1.

FIG. 2 shows a side view of the embodiment of FIG. 1, and illustrates the principle of operation of the present invention. A golf ball 23 is placed adjacent to the second end 18 of the upper mat 12. A swing path 25 of the golf club head 27 is shown to illustrate how the device creates space to better mimic a shot off of natural turf. The swing path 25 corresponds to the anticipated trajectory of the club head 27. The critical space created by this design is indicated by the area delineated by broken lines and designated by reference number 27. As is shown, the swing path extends below the upper mat 12 as the club passes through the ball 23 and after the ball is struck by the club and into the space 26. On natural turf, this normal swing path would result in a divot being taken from the turf, which would weigh only a few ounces and would absorb very little force. On previously known practice mats, however, this swing path would result in a significant collision between the club head and the mat—the majority of the force of which would have to be absorbed by the hands and arms of the golfer.

The combination of the connector 13 and the anchoring connector 14 secures the device 10 against movement in the direction of the swing path. That is, the device will not move substantially in the direction of the intended shot, even if the user's swing results in the device being struck by the club head. The anchoring connector 14 is advantageously tied to an object far behind the golfer, such as a golf bag.

Similarly, the connector 13 ensures that the upper mat 12 does not move substantially relative to the lower mat 11 when a ball is hit with proper or close to proper technique. In the embodiment shown in FIG. 1, the connector 13 comprises a flat, knitted elastic webbing that is capable of stretching approximately 100% of its original length. Other types of connectors are used in other embodiments. In some embodiments, the degree of elasticity of the first connector 13 is varied, such that the connector in some embodiments is capable of stretching only 50%, while in other embodiments it is capable of stretching 150% or even 200%. In some embodiments, the connector is a round elastic cord. In other embodiments, the connector 13 is not elastic, such that it has a substantially fixed length.

The connector 13, whether it is elastic or inelastic is intended to secure the mats together such that their first ends 15 and 16 are substantially aligned. The alignment of the first ends and the difference in the sizes of the mats ensures that the open space 26 is created as shown in FIGS. 1 and 2. The connector 13 is also designed, in some embodiments, to permit a small amount of movement of the upper mat relative to the lower mat in instances when the user makes a "fat" type mis-hit. Such movement is limited by the connector to around 20% of the length of the upper mat in most embodiments. This means that, when a user strikes the upper mat 12 too far behind the ball, the upper mat will slide forward (in the direction of the path of the club head) a short distance to help alleviate some of the force of the mis-hit. The feedback given to the user will accurately reflect the mis-hit—it is extremely unlikely that a "fat" mis-hit off of the device of FIG. 1 will result in a well-struck ball. Much more likely is that the lie of the ball on the edge of the upper mat will be upset once the club strikes the mat, causing the ball to move relative to the face of the club. The resulting shot will be poor. Accordingly, the false feedback problem associated with use of other artificial turf practice mats is alleviated.

In other embodiments, the connector 13 is sized and/or the material is specified such that the upper mat can move more than or less than the 20% described above. In some embodiments, the connector 13 permits movement of the upper mat of about 5%, 7.5%, 10%, 12.5%, 15%, 17.5%, 20%, 22.5%, 25%, 27.5%, 30%, 32.5%, 35%, 37.5%, or 40% of the length of the upper mat. Due to the elastic nature of the connector 13 in some embodiments, the upper mat will return to its initial position in which the first ends of the upper and lower mats are aligned after the club head strike.

The anchoring connector 14 is, in most embodiments, an inelastic connector intended to be secured to an object that will prevent movement of the device 10 when it is used for golf shots. For example, in the embodiment shown, the anchoring connector 14 is approximately 10 feet long so that it can be tied to an object far behind the area in which the user will be swinging a golf club, such as the user's golf bag. In other embodiments, the anchoring connector 14 is an elastic cord or rope. In such embodiments, the anchoring connector provides a small amount of additional movement of the device in response to a "fat" mis-hit. For less experienced golfers, use of an elastic material for the anchoring connector 14 is recommended, as it will provide additional force reduction and feedback on mis-hits.

Generally, however, the anchoring connector 14 serves to substantially anchor the mat 10 against movement in at least one direction. In most cases, this is the direction of the club head trajectory and anticipated direction of travel of the golf ball. In embodiments in which a single rope or cord is used as the anchoring connector 14, the mat 10 is permitted to move in all directions except for one. In other embodiments in which the anchoring connector 14 comprises two or more ropes or cords, the mat 10 is restricted from movement in more than just one direction.

As stated above, embodiments of the present invention significantly reduce the shock that causes a golfer to develop tendinitis when using artificial turf practice mats. They also significantly reduce false feedback on "fat" hits.

In the embodiment shown and in most preferred embodiments, the mats are formed of plastic artificial grass. A close-up view of a portion of the device is provided in FIG. 2, and shows the details of the artificial turf. A golf ball 23 is shown placed adjacent to the second end 18 of the upper mat 12. The mats are made from commercially available material from Grassworx, LLC. One particularly well-suited product is the "Astroturf Clean Machine Scrapper Mat." Other brands of artificial turf are used in other embodiments of the invention. Different types of materials are used in other embodiments, including various rug, carpet, and mat materials. Those of skill in the art will understand to select the materials appropriate for repeated golf shots that will exhibit sufficient longevity and playability.

In the embodiment shown in FIGS. 1 and 2, the lower mat 11 is thicker than the upper mat 12. The thickness refers to the distance from the bottom of the mat to the top of the blades of artificial grass. In this embodiment, the thickness of the lower mat is approximately ¾ths of an inch, while the upper mat is approximately ⅝ths of an inch thick. In other embodiments, both mats are ⅝ths of an inch thick. Different mat thicknesses are used in other embodiments. The thickness of the upper mat 11 is important as it determines the amount of space in front of the ball through which the club head passes during a follow-through. Expert golfers who rarely mis-hit may prefer a thinner upper mat. A thinner upper mat leaves less space in front of the ball, which increases the likelihood that the club head will strike the lower mat. In such embodiments, the upper mat is approximately ½ inch thick, while the lower mat is either approximately ¾ths or ⅝ths of an inch thick. Less experienced golfers will likely prefer a thicker upper mat as this creates more space in front of the ball to accommodate the path of travel of the club head. This additional space helps accommodate wider variation in swing path, which is typical of less experienced golfers. In general, however, the upper and lower mats are between ¼ inch and ¾ inches thick. In the most preferable embodiments, however, the thickness of the upper mat is ⅝ths of an inch thick, because this corresponds roughly to the thickness of an ideal divot. An ideal divot is about the shape and size of a dollar bill, which is 6 and ⅛th inches long. The ideal divot is also typically less than ½ inch thick. Thus, when the upper mat is ⅝ths of an inch thick, the space 26 will be thick enough to accommodate a proper swing and follow-through.

In some embodiments, the lower mat is formed of a material that is sturdier, and thus, in some cases, heavier than the upper mat. This is done to improve the longevity of the mat. In other embodiments, a coating is applied to the bottom of the lower mat to improve its strength and resistance to water. Such a coating is in the form of an epoxy resin or similar material in some embodiments.

Figure 4B:
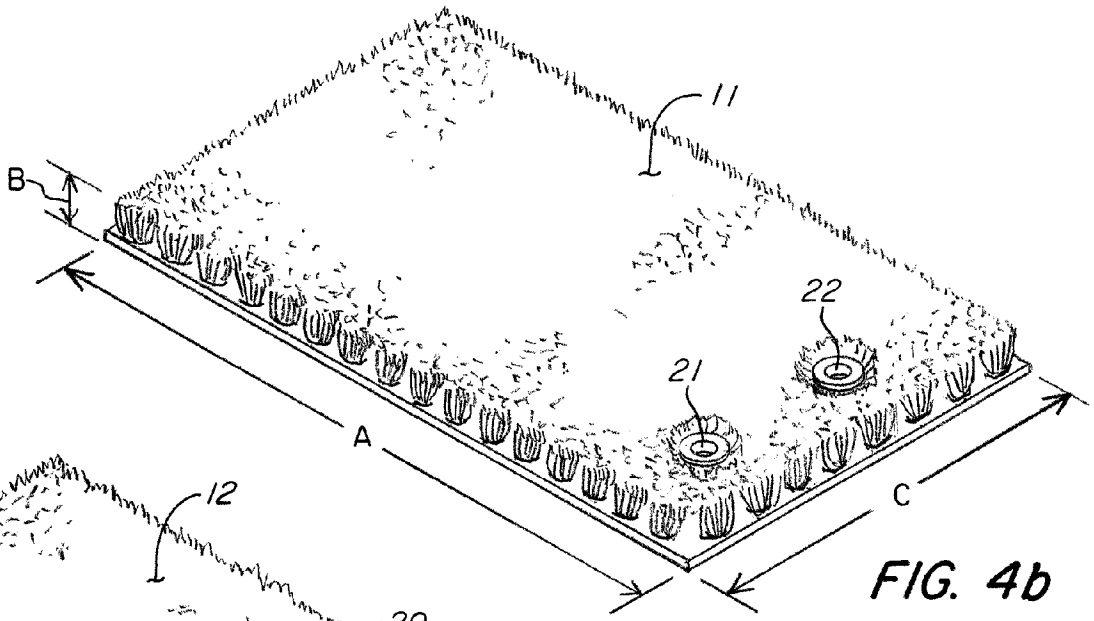
FIG. 4*b* is an elevation view of a component of the embodiment of FIG. 1.
Figure 4A:
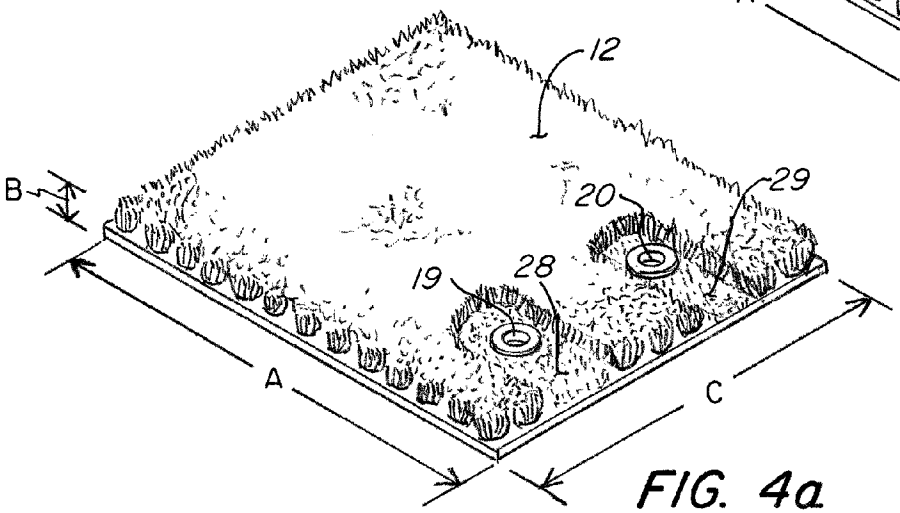
FIG. 4*a* is an elevation view of a component of the embodiment of FIG. 1.

FIGS. 4*a* and 4*b* show the upper and lower mats, respectively, disconnected from one another. The upper mat has two openings 19 and 20, through which the connector 13 is threaded (as shown in FIG. 1). The lower mat also has two openings 21 and 22. In preferred embodiments, the openings 19, 20, 21, and 22 have grommets installed therein to strengthen the openings. FIG. 4*a* also shows that the upper mat 12 has portions 28 and 29 at which the artificial grass blades have been trimmed. This feature helps extend the life of the connector 13 by reducing the friction of the blades against it. Artificial grass blades can occasionally be sharp.

FIGS. 4*a* and 4*b* also show the dimensions of the mats as referred to herein. Dimension A indicates the length of the mat. Dimension B indicates the thickness of the mat. Dimension C indicates the width of the mat.

Figure 3:
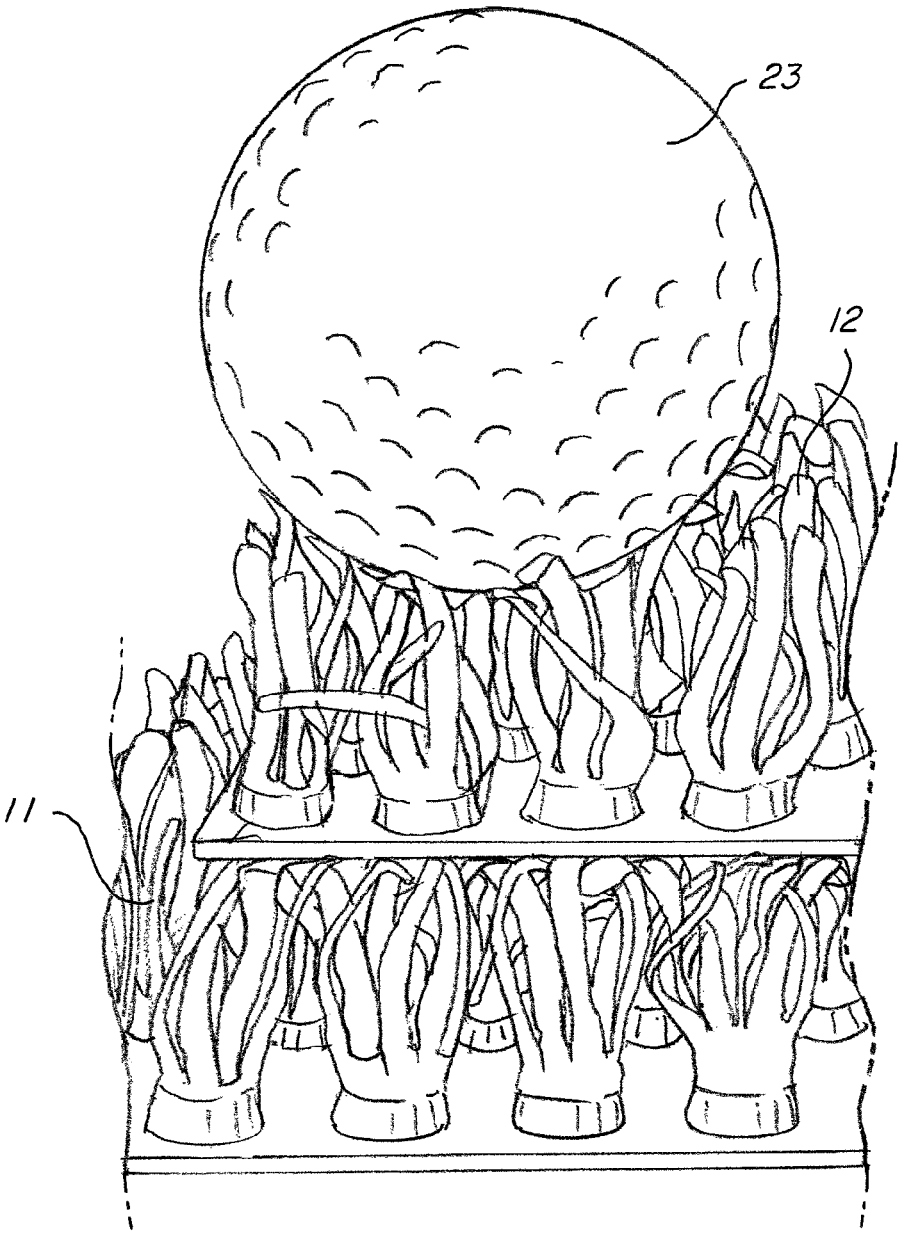
FIG. 3 is a close up view of a portion of the embodiment shown in FIG. 1.
Figures 5, 6A, 6B, 6C:
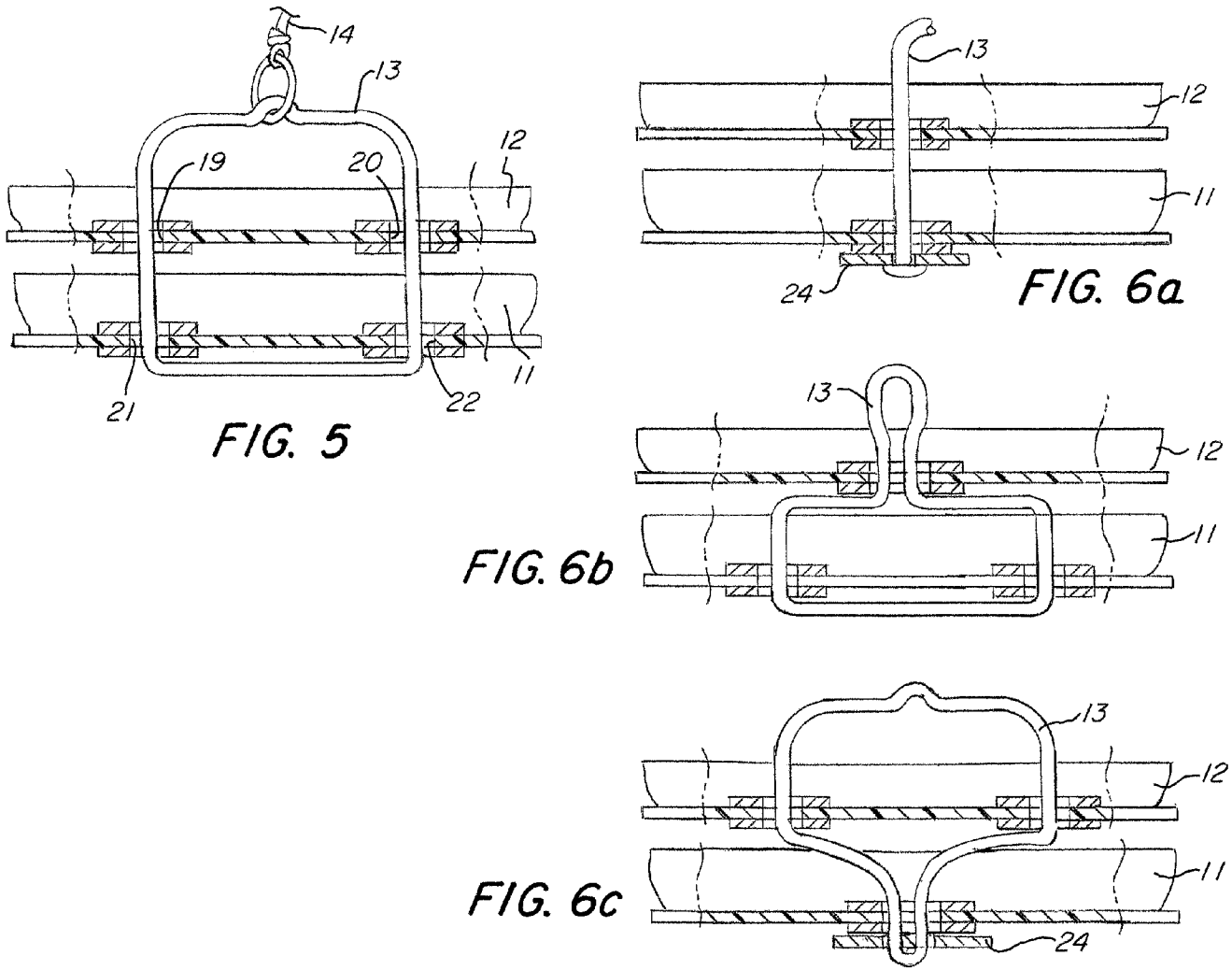
FIG. 5 is an end view of the embodiment of FIG. 1.
FIGS. 6*a*, 6*b*, and 6*c*, are end views of alternative embodiments of the present invention.

FIG. 5 shows the way in which the upper and lower mats are secured together using the connector 13. In this embodiment, which is also shown in FIGS. 1, 2, and 3, the openings 19, 20, 21, and 22 of the upper and lower mats line up when the mats are stacked on top of each other and when the first ends 15 and 16 are substantially aligned. This permits the mats to be secured by threading the connector 13 first through the opening 19 of the upper mat, then through opening 21 of the lower mat, then up through the opening 22 of the lower mat, then up through the opening 20 of the upper mat. The connector 13 can then be tied or otherwise secured into a loop and connected to the anchoring connector 14.

In other embodiments, the mats have different configurations of openings. FIGS. 6*a-c* show examples of such embodiments. In FIG. 6*a*, each of the mats have a single opening through which the connector 13 is threaded. In this embodiment, a stopper 24 is used to secure the end of the connector 13 and prevent it from being pulled through the openings in the mats. In FIG. 6*b*, the upper mat has a single opening, while the lower mat has two openings through which the connector 13 is threaded. In FIG. 6*c*, the upper mat has two openings and the lower mat has a single opening. In the embodiment of FIG. 6*c*, a stopper 24 is used to secure the connector 13 on the underside of the lower mat 11.

Figure 7:
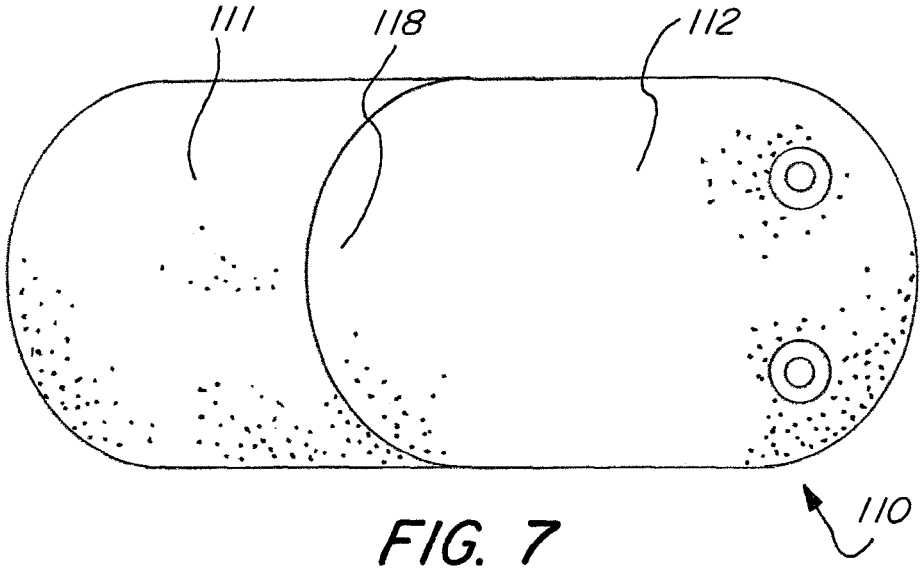
FIG. 7 is a top view of an alternative embodiment of the present invention.
Figure 8:
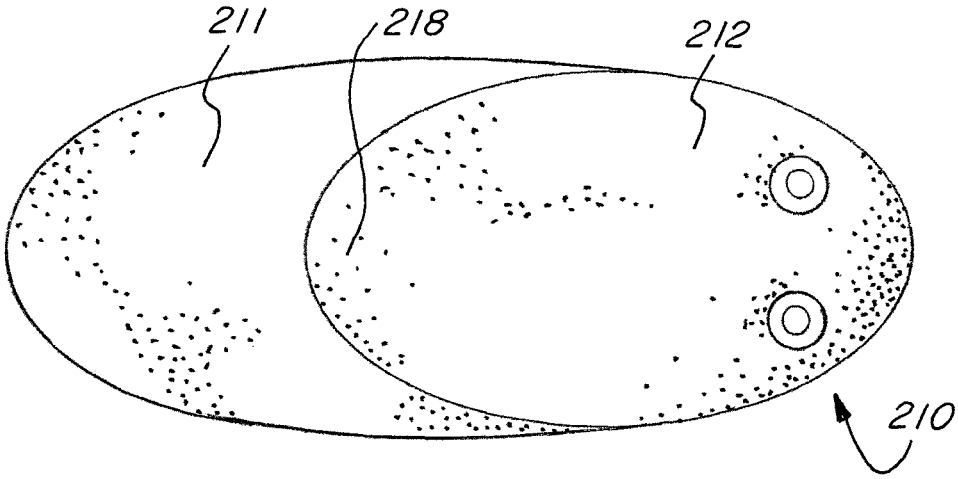
FIG. 8 is a top view of a second alternative view of the present invention.

In other embodiments, such as those shown in FIGS. 7 and 8, the upper and lower mats have non-rectangular shapes. In FIG. 7, the first and second ends of the mats 111, 112 do not comprise straight edges, as in the embodiment of FIG. 1, but, rather, curved edges. Similarly, in FIG. 8, the upper and lower mats 211, 212 have elliptical (or oval) shapes. As in the embodiment of FIG. 1, proper operation of the embodiments of FIGS. 7 and 8 require that the lower mat have additional length or additional surface area that extends beyond the second end 118, 218 of the upper mats 112, 212.

The device of Figure one is used as follows. First, the golfer places the mat 10 on the ground where he or she will be hitting golf balls. At a driving range with a traditional artificial turf mat, the mat 10 may be placed next to the traditional mat so that the golfer stands on the traditional mat while hitting balls off of the mat 10. Next, the golfer extends the anchoring connector 14 away from the mat 10 and secures it to an object so that there is not excessive slack in the anchoring connector 14. It is often advantageous for the golfer to secure the connector 14 to his or her golf bag. Then, the golfer places a golf ball adjacent to the second edge 18 of the upper mat 12 as shown in FIG. 3. The golfer then addresses the ball and takes the shot.

Because the golf ball is placed on the edge of the upper mat 12, the golfer is able to hit the ball and follow through down through the space 26 where the lower mat 11 extends beyond the upper mat 12. This gives a similar feel to a ball strike as a good shot made on a nice fairway. There will be little or no shock delivered back to the golfer. In addition, if the golfer makes a "fat" hit and strikes behind the ball, a poor shot will result, in contrast with a normal golf mat wherein the club "bounces" into the ball giving the golfer the false impression that he has produced a good shot.

In some applications, particularly when the mat is used by a less experienced golfer, the mat is placed on a larger practice mat. Generally, however, the top of the upper mat should be approximately level with the surface on which the golfer is standing to take his or her shots. For example, some driving ranges or golf simulator facilities provide a cut-out portion of the practice mat into which the mat of the present invention can be placed for use. Again, the thickness of the lower mat can be varied to achieve the desired height of the upper mat.

Embodiments of the invention are lightweight and have a relatively small size such that they are highly portable. A golfer can keep a device such as that shown in FIG. 1 in his or her bag when the golfer goes to a driving range. He will place it next to the normal driving range mat so the top of the top piece of the device is at the same height as the surface of the driving range mat.

While this invention has been described in specific terms related to an exemplary embodiment or embodiments, it will be understood by those of skill in the art that modifications may be made in the configurations and dimensions of those embodiment(s) without departing from the following claims.

What is claimed is:

1. A golf swing practice device, comprising:

a lower mat having first and second ends, a first length and a first thickness;

an upper mat having first and second ends, a second length and a second thickness, wherein the second length is less than the first length; and a first connector that substantially secures the upper mat on top of the lower mat when the device is in use;

wherein the upper mat is arranged on top of the lower mat such that the first ends of the mats are substantially aligned and the second ends of the mats are separated by approximately the difference between the second and first lengths;

wherein the lower mat and the upper mat each comprise at least one opening adjacent the first end of each mat and wherein the first connector comprises an elastic cord threaded through each of the at least one openings.

2. The device of claim 1, wherein the lower mat comprises a first opening and a second opening adjacent the first end of the lower mat, and wherein the upper mat comprises a third opening and a fourth opening adjacent the first end of the upper mat.

3. The device of claim 2, further comprising that each of the first, second, third, and fourth openings comprises a grommet.

4. The device of claim 1, wherein the first connector limits movement of the upper mat relative to the lower mat along the first length of the lower mat to no more than approximately 20% of the second length.

5. The device of claim 1, further comprising an anchoring connector connected to the first connector for substantially anchoring the device against movement in at least one direction.

6. The device of claim 1, wherein the second thickness is less than the first thickness.

7. The device of claim 1, wherein the second length is approximately ⅔rds of the first length.

8. The device of claim 1, wherein the second thickness is approximately ⅝ths of an inch and the first thickness is approximately ¾ths of an inch.

9. The device of claim 1, wherein the upper and lower mats comprise an artificial grass surface.

10. The device of claim 1, wherein the second thickness is between approximately ¼th and ¾ths of an inch thick.

11. The device of claim 1, wherein the first length is approximately 12 inches, and the second length is approximately 8 inches.

12. A method for reducing the force of a golf club striking a surface during golf shots, comprising the steps of:

securing a first playing surface on top of a second playing surface by threading an elastic cord connector through at least one opening in each of the first and second playing surfaces, the first playing surface having a smaller surface area than the second playing surface, wherein the playing surfaces are arranged such that an additional surface area of the second playing surface extends in the direction of an anticipated trajectory of a club head of a golf club;

placing a golf ball on the first playing surface nearest an edge of the first playing surface that is nearest the additional surface area of the second playing surface; and swinging the golf club such that the club head of the golf club strikes the ball before passing over the edge of the first playing surface.

13. The method of claim 12, further comprising the step of securing the first and second playing surfaces to an object such that movement of the first and second playing surfaces is substantially eliminated in the direction of the anticipated trajectory of the club head.

14. A golf swing practice device, comprising:

an upper mat having a first surface area, a first end, a second end, and at least one opening adjacent to the first end of the upper mat;

a lower mat having a second surface area, a first end, a second end, and at least one opening adjacent to the first end of the lower mat, wherein the second surface area is greater than the first surface area;

a first connector threaded through the openings such that the upper mat is on top of the lower mat and the first ends of the mats are substantially aligned when the device is in use; and an anchoring connector connected to the first connector for substantially anchoring the device against movement in at least one direction;

wherein the upper and lower mats are arranged such that the second end of the upper mat is separated from the second end of the lower mat by a length of the additional surface area of the lower mat;

wherein the upper mat is between approximately ¼th and ¾ths of an inch thick.

15. The device of claim 14, wherein the first connector is elastic and is arranged to limit movement of the upper mat relative to the lower mat along an axis extending from the first end to the second end of the lower mat to no more than approximately 20% of a length the upper mat.

16. The device of claim 15, wherein the upper mat comprises two openings adjacent the first end of the upper mat and the lower mat comprises two openings adjacent the first end of the lower mat, and wherein each opening comprises a grommet.

17. The device of claim 15, wherein the anchoring connector is a substantially inelastic cord.

18. The device of claim 14, wherein the upper mat and the lower mat are each approximately ⅝ths of an inch thick.

19. The device of claim 14, wherein the first surface area is approximately ⅔rds of the second surface area.

20. The device of claim 14, wherein the upper mat and the lower mat have approximately the same width.

21. The device of claim 14, wherein the first connector comprises at least one elastic cord.

22. The device of claim 14, wherein the upper mat is approximately 8 inches long between the first end and the second end and the lower mat is approximately 12 inches long between the first end and the second end.

23. The device of claim 14, wherein the upper mat is approximately ½ inch thick.

* * * * *